US007341064B2

(12) United States Patent
Habibi

(10) Patent No.: US 7,341,064 B2
(45) Date of Patent: Mar. 11, 2008

(54) TOOTHED HEATED HAIR STYLING DEVICE AND METHOD OF MANUFACTURE

(76) Inventor: Masood Habibi, P.O. Box 71104, Los Angeles, CA (US) 90071

( * ) Notice: Subject to any disclaimer, the term of this patent is extended or adjusted under 35 U.S.C. 154(b) by 646 days.

(21) Appl. No.: 10/390,579

(22) Filed: Mar. 14, 2003

(65) Prior Publication Data

US 2004/0003824 A1 Jan. 8, 2004

Related U.S. Application Data

(60) Provisional application No. 60/364,610, filed on Mar. 15, 2002.

(51) Int. Cl.
*A45D 1/00* (2006.01)

(52) U.S. Cl. ..... 132/224

(58) Field of Classification Search ..... 132/118, 132/224, 225, 269–272, 141, 142; 219/225–228, 219/330–331

See application file for complete search history.

(56) References Cited

U.S. PATENT DOCUMENTS

| | | | | |
|---|---|---|---|---|
| 190,960 | A | 5/1877 | Davis | |
| 1,465,838 | A | 8/1923 | Caneavri | |
| 1,588,241 | A | 6/1926 | Leland | |
| 1,731,522 | A | 10/1929 | Carlson | |
| 1,852,269 | A | 4/1932 | Siers | |
| 1,858,851 | A | 5/1932 | Buchanan | |
| 1,892,107 | A | 12/1932 | Jancke et al. | |
| 1,894,431 | A | 7/1933 | Vaghelatos | |
| 1,926,987 | A | 9/1933 | Durham et al. | |
| 1,957,049 | A | 5/1934 | Lakenbach | |
| 2,244,068 | A | 6/1941 | Kay | |
| 2,720,207 | A | 10/1955 | Burtnett | |
| 2,818,869 | A | 1/1958 | Rose | |
| 3,108,603 | A | 10/1963 | Mobberley | |
| 4,623,779 | A | 11/1986 | Raab | 219/222 |
| 4,739,151 | A | 4/1988 | Smal | |

(Continued)

FOREIGN PATENT DOCUMENTS

GB 539653 * 9/1941

(Continued)

OTHER PUBLICATIONS

International Search Report, for International Application No. PCT/US03/08295, date mailed Dec. 4, 2003.

*Primary Examiner*—Todd E. Monahan
*Assistant Examiner*—Rachel A. Running
(74) *Attorney, Agent, or Firm*—Thelen Reid Brown Raysman & Steiner LLP; David B. Ritchie

(57) ABSTRACT

A hair styling apparatus includes a pair of mating surfaces which engage one another and a handle which guides them into engagement at the manual control of a user. Hair to be styled is placed between the engaged surfaces. A plurality of pins extend from one of the surfaces and engage holes in the other of the surfaces. In another aspect of the invention, one or both surfaces may incorporate a source of dry heat. In yet another aspect of the invention, a source of steam is provided together with a trigger for discharging the steam through holes in at least one of the surfaces as an aid to hair styling.

16 Claims, 16 Drawing Sheets

U.S. PATENT DOCUMENTS

| | | | | | |
|---|---|---|---|---|---|
| 4,917,078 | A | | 4/1990 | Zaborowski | 126/409 |
| 5,212,366 | A | | 5/1993 | McDougall | 219/222 |
| 5,232,137 | A | | 8/1993 | Devine | |
| 5,263,501 | A | | 11/1993 | Maznik | |
| 5,294,777 | A | | 3/1994 | Denhup | 219/225 |
| 5,400,809 | A | | 3/1995 | Adams | 132/118 |
| 5,799,671 | A | | 9/1998 | Takimae | 132/225 |
| 5,868,146 | A | | 2/1999 | Henninger et al. | |
| D411,333 | S | | 6/1999 | Smal | D28/35 |
| 5,934,293 | A | | 8/1999 | Kaizuka | 132/225 |
| 6,029,677 | A | * | 2/2000 | Nanba et al. | 132/225 |
| 6,070,596 | A | * | 6/2000 | Altamore | 132/224 |
| 6,098,633 | A | * | 8/2000 | Pabari | 132/142 |
| 6,119,702 | A | * | 9/2000 | Habibi | 132/225 |
| 6,191,387 | B1 | | 2/2001 | Smal | 219/225 |
| D440,710 | S | | 4/2001 | Kaizuka | D28/35 |
| 6,223,753 | B1 | | 5/2001 | Lo | 132/224 |
| 6,477,732 | B1 | | 11/2002 | Cline et al. | 15/185 |
| D479,626 | S | | 9/2003 | Colombo | D28/35 |
| D482,491 | S | | 11/2003 | Maesawa et al. | D28/35 |
| D489,482 | S | | 5/2004 | Cho | |

FOREIGN PATENT DOCUMENTS

| | | |
|---|---|---|
| JP | 58-92311 | 1/1983 |
| JP | 09191920 | 7/1997 |

* cited by examiner

TOOTHED HEATED HAIR STYLING DEVICE AND METHOD OF MANUFACTURE

RELATED APPLICATIONS

This application claims the benefit of prior co-copending U.S. provisional patent application Ser. No. 60/364,610, filed Mar. 15, 2002 in the name of Masood Habibi and entitled "Toothed Heated Hair Styling Device and Method of Manufacture".

This application is also related to U.S. design patent application Ser. No. 29/177,850 filed on even date herewith, entitled "Toothed Heated Hair Styling Device" and submitted by the same applicant. The related applications are hereby incorporated herein by reference as if set forth fully herein.

BACKGROUND OF THE INVENTION

1. Field of the Invention

The present invention relates generally to the field of hair care and styling. More particularly, the present invention relates to a hair styling system which incorporates a heating system so as to provide a new tool for styling, straightening, curling and curving hair.

2. The Background

Many devices have been devised over the ages to aid in styling hair. Hair curlers, for example, are used to impart curls into hair. They may be used on dry hair but work best on wet hair. Steam may be applied to assist in setting the hair to the curl of the curlers. Curling irons typically incorporate an electrical heating element to heat one or both sides of a smooth but curved pair of mating surfaces between which hair is placed to be curled. The hair may preferably be pulled through the interface of the mating surfaces of the curling iron to aid in curling the hair. On the other hand, hair straighteners and smoothers operate much like curling irons, but they have flat or curved, smooth mating surfaces which act more like a clothes iron to straighten and/or smooth, or curve or curl the hair when compressed against and pulled along the hair.

All known examples of such irons and straighteners comprise a pair of untextured surfaces for engaging the hair. As a result, the hair can become tangled, or require much additional brushing with another apparatus such as a brush in order to achieve the desired style. This additional brushing can undesirably disrupt the style imparted by the irons and straighteners. Furthermore, it would be beneficial to obviate this need for an additional implement because the time required to style the hair could be reduced and less heat would need to be imparted to the hair because the styling process would take less time.

Accordingly, it would be desirable to provide hair styling devices capable of use in curling, straightening, smoothing, curving and/or waving hair.

SUMMARY OF THE INVENTION

A hair styling apparatus includes a pair of mating surfaces which engage one another and a handle which guides them into engagement at the manual control of a user. Hair to be styled is placed between the engaged surfaces. A plurality of pins extend from one of the surfaces and engage holes in the other of the surfaces. In another aspect of the invention, one or both surfaces may incorporate a source of dry heat. In yet another aspect of the invention, a source of steam is provided together with a trigger for discharging the steam through holes in at least one of the surfaces as an aid to hair styling.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

In the drawings.

DETAILED DESCRIPTION

Embodiments of the present invention are described herein in the context of a toothed heated hair styling device and method of manufacture thereof. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
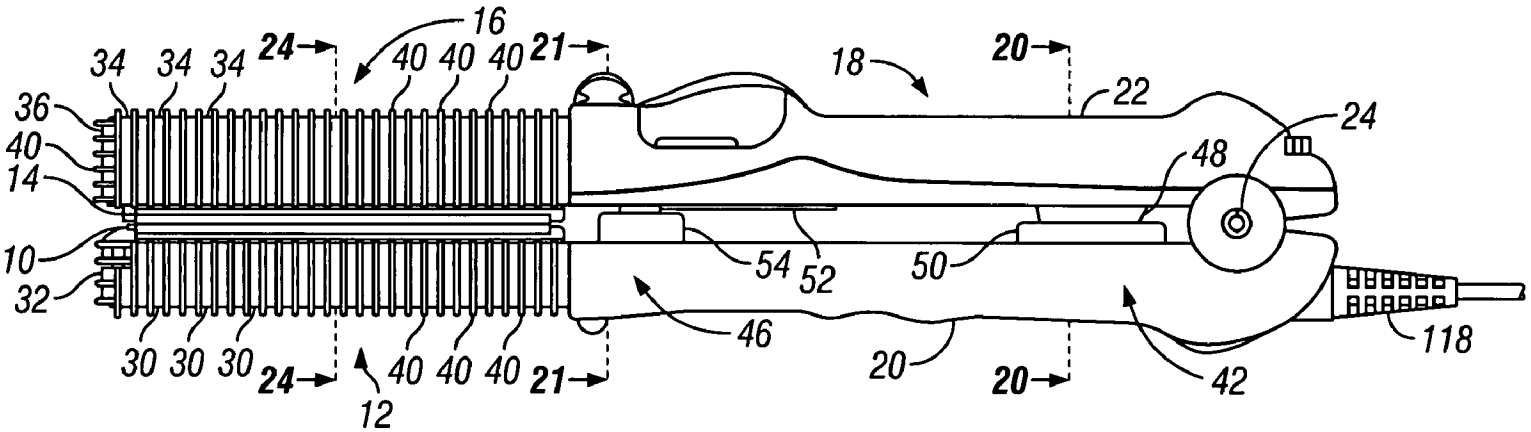
FIG. 1 is a side view of an apparatus for hair styling in accordance with one embodiment of the present invention.
Figure 2:
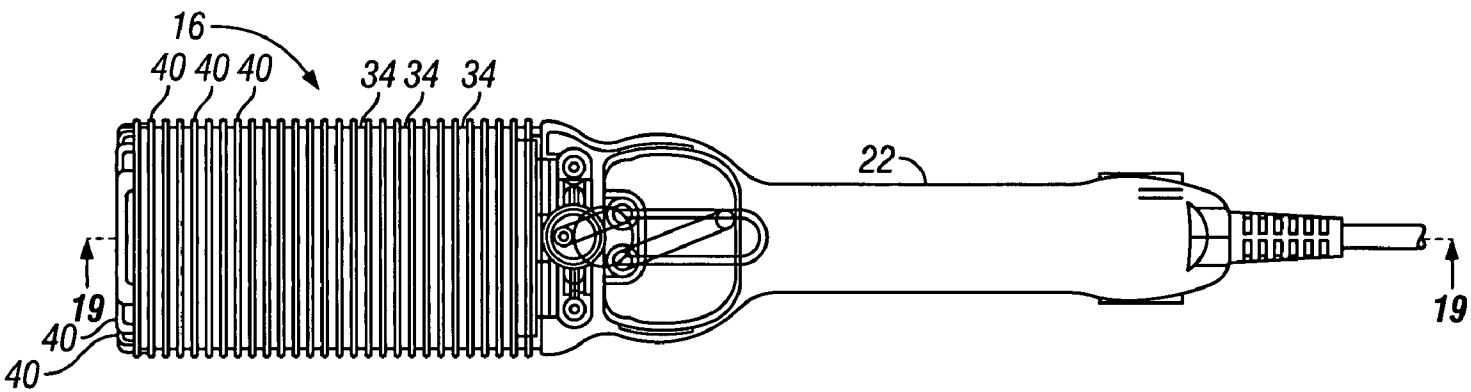
FIG. 2 is a top view of an apparatus for hair styling in accordance with one embodiment of the present invention.

In the embodiment shown in FIG. 1 a first plate 10 is connected to a first housing 12 and second plate 14 is connected to a second housing 16. The proximal ends of the housings 12 and 16 are connected to handle 18 which includes a first handle member 20 to which first housing 12 is attached and a second handle member 22 to which second housing 16 is attached.

The first handle member 20 and second handle member 22 are connected together at their proximal ends by hinge 24 and optionally biased toward an open position as, for example, with a spring (not shown). An operator may press the handle members 20 and 22 together to engage the first plate 10 and second plate 14 together in close conformance with hair to be styled disposed between the plates.

Figure 3:
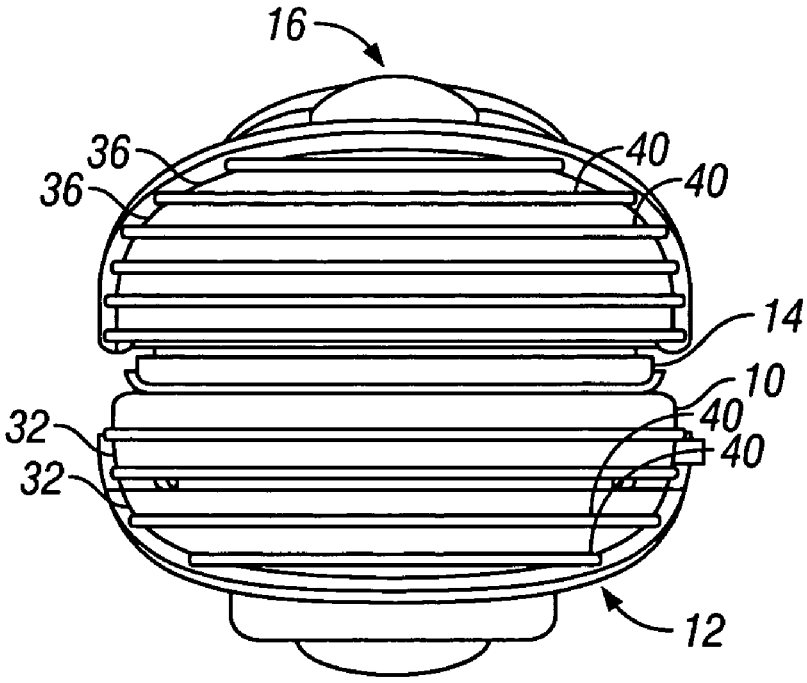
FIG. 3 is a front end view of an apparatus for hair styling in accordance with one embodiment of the present invention.
Figure 4:
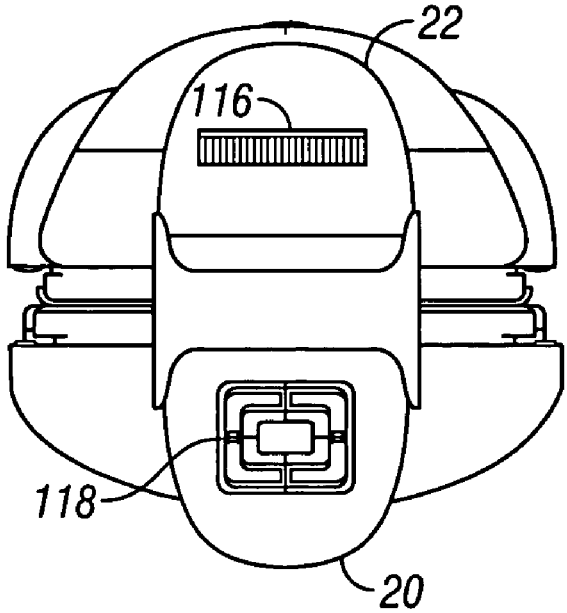
FIG. 4 is a rear end view of an apparatus for hair styling in accordance with one embodiment of the present invention.
Figure 5:
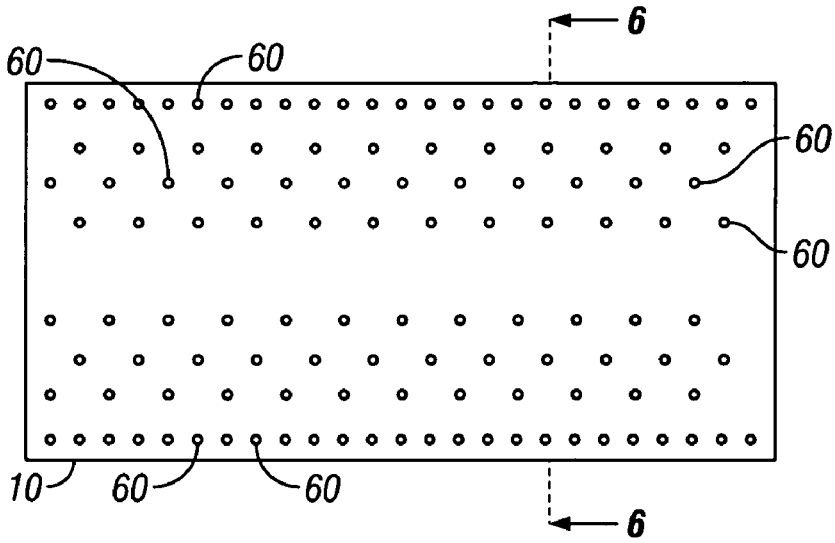
FIG. 5 is a top plan view of one flat surface having pins, of a hair styling apparatus in accordance with one embodiment of the present invention.
Figure 6:
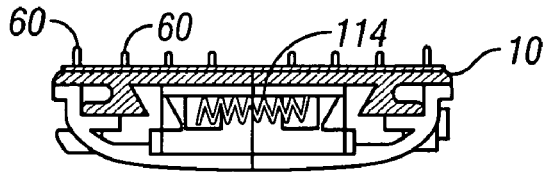
FIG. 6 is a cross sectional view of the surface shown in FIG. 5 taken along line 6-6 of FIG. 5.
Figure 7:
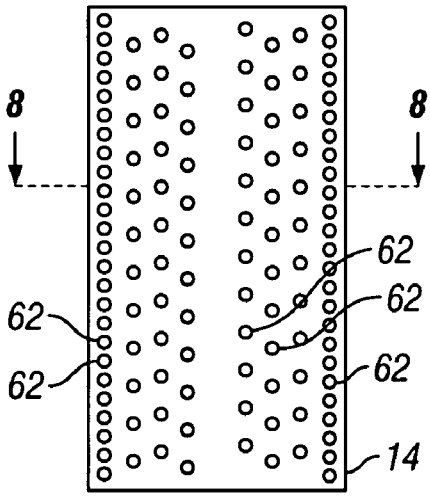
FIG. 7 is a plan view of one flat surface having apertures, of a hair styling apparatus in accordance with one embodiment of the present invention.
Figure 8:
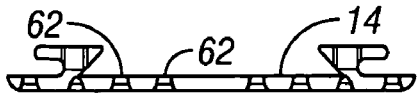
FIG. 8 is a cross sectional view of the surface shown in FIG. 7 taken along line 8-8 of FIG. 7.
Figure 24:
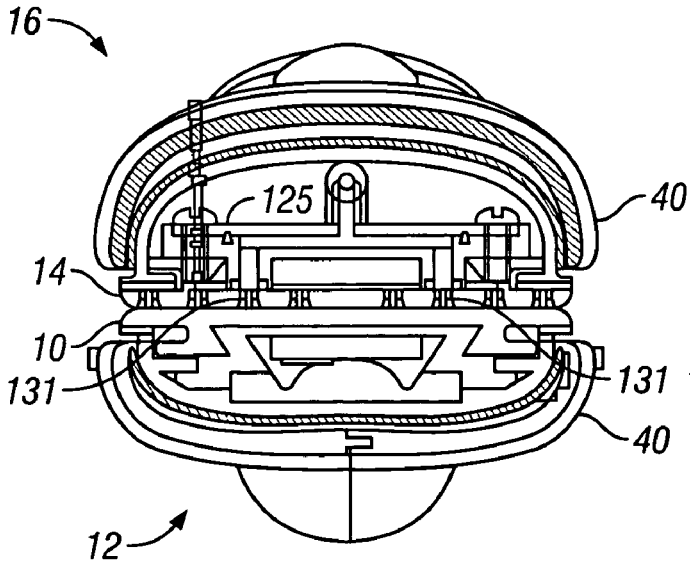
FIG. 24 is a cross sectional view of the device shown in FIG. 1, taken along line 24-24 of FIG. 1.
Figure 25:
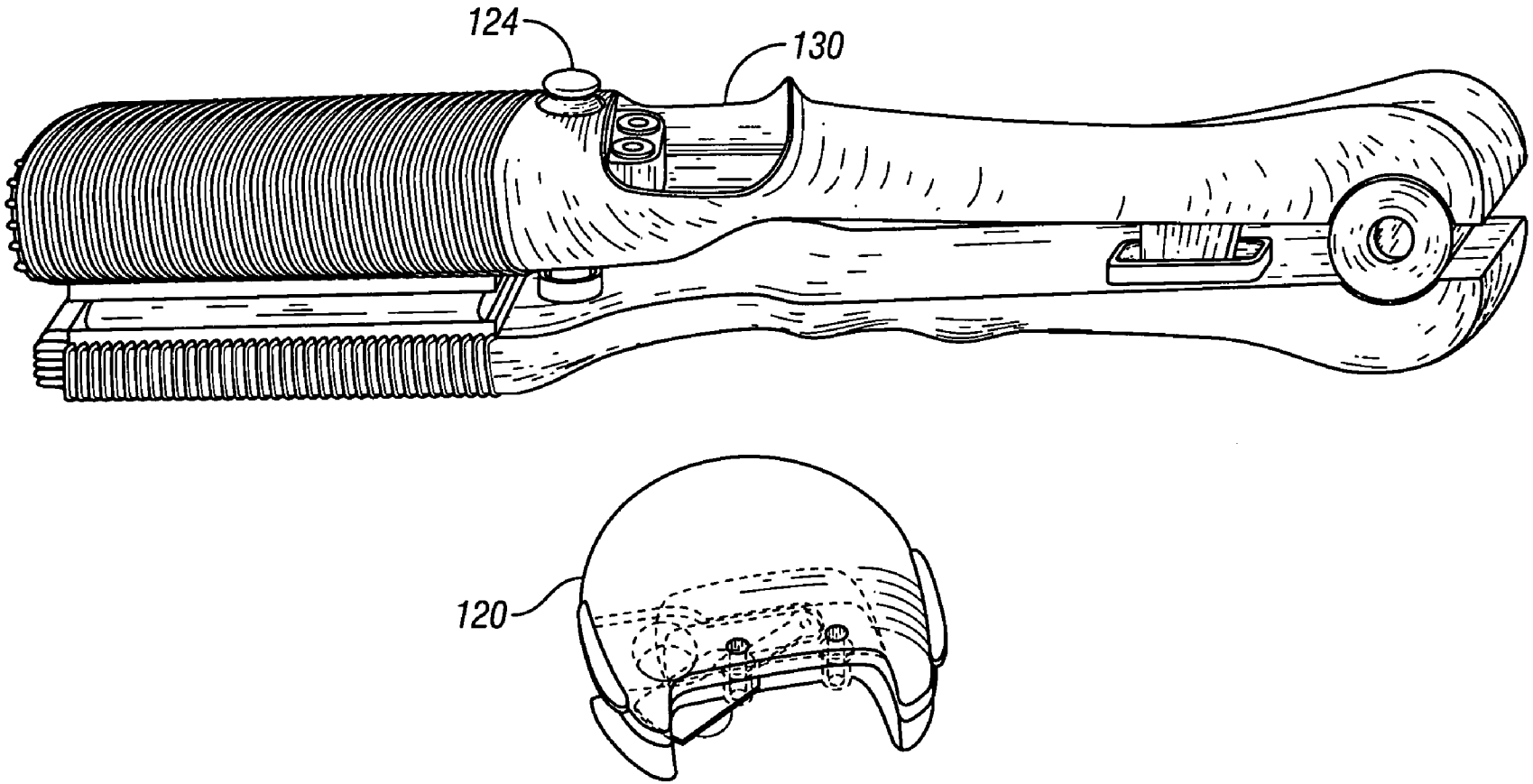
FIG. 25 is a front perspective view of the device shown in FIG. 1 showing the water chamber removed.

The first housing 12 includes a face member 30 and an end member 32. Likewise the second housing 16 includes a face member 34 and an end member 36. A plurality of fins 40 are coupled to the face member 30 and end member 32 of the first housing 12, and a plurality of fins 40 are coupled to the face member 34 and end member 36 of the second housing 16. Each of the fins 40 comprises in one embodiment of the present invention a substantially flat, thin ridge of constant height, having one edge coupled to a face member or end member and terminating in a rounded end spaced apart from the face member or end member. The fins on a face member are in one embodiment of the present invention all substantially parallel to one another and spaced apart from each other a constant distance throughout their length. Likewise the fins on an end member are in one embodiment of the present invention all substantially parallel to one another and spaced apart from each other a constant distance throughout their length. As can be seen best in FIGS. 1 and 24 the fins 40 located on a face members 30 and 34 extend from a location adjacent one edge of a plate 10 or 14 to a location adjacent the opposing edge of the same plate. As can best be seen in FIGS. 1 and 3, the fins 40 located on an end member 32 or 36 extend from one edge the end member to the opposing edge of the same end member.

During operation of the device the face members 30 and 34 and the end members 32 and 36 become hot. However, the exposed ends of the fins do not get significantly hotter than ambient temperature. All of the fins 40 are spaced apart from one another a distance less than the width of a finger so that a user of the apparatus may grasp it or inadvertently touch it without touching the face members 30 or 34 or the end members 32 or 36. Thus the fins 40 help protect the user from being burned by the face members or end members.

Figure 20:
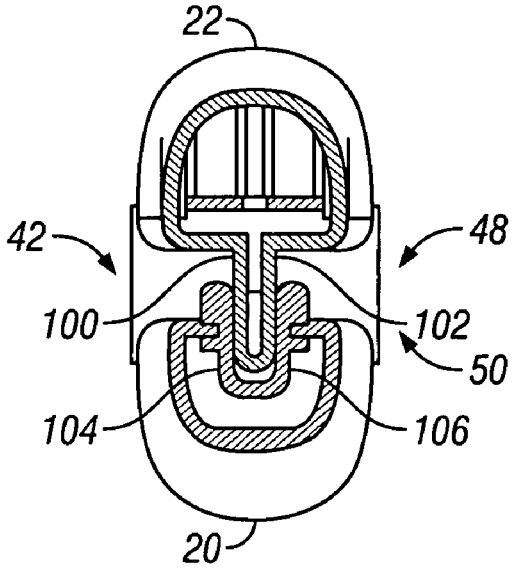
FIG. 20 is a cross sectional view of the device shown in FIG. 1, taken along line 20-20 of FIG. 1.
Figure 21:
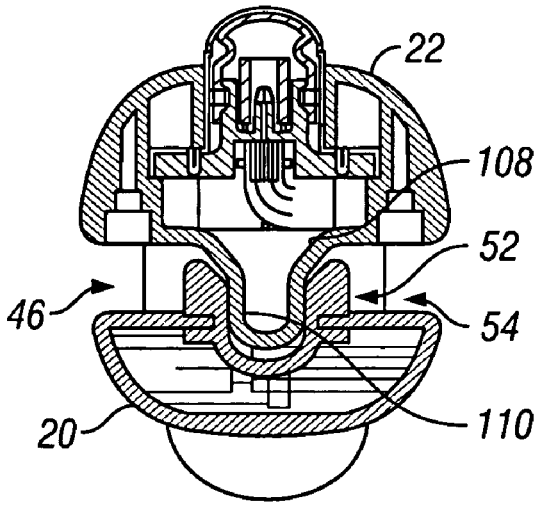
FIG. 21 is a cross sectional view of the device shown in FIG. 1, taken along line 21-21 of FIG. 1.

The handle 18 includes a proximal guide 42 and a distal guide 46 which assist in alignment of the first and second plates 10 and 12 when a user closes the device. As best shown in FIGS. 20 and 21, the proximal guide 42 includes a proximal male alignment part 48 coupled to the second handle member 22 and a proximal female alignment part 50 coupled to the first handle member 20. Similarly, the distal guide 46 includes a distal male alignment part 52 coupled to the second handle member 22 and a distal female alignment part 54 coupled to the first handle member 20.

Turning now to FIGS. 5-8 and 29-31, the first plate 10 has a plurality of pins or tangs 60 disposed thereon. The second plate 14 has a plurality of holes 62 disposed therein. Pins 22 and holes 24 are formed and located so that pins 60 enter holes 62 when first plate 10 and second plate 14 are in close face-to-face relationship when the apparatus is in the "closed" configuration.

Those of ordinary skill in the art will now realize that the diameter, especially the entry diameter, of holes 62; the length and thickness of pins 60; and the length and orientation of first plate 10 and the second plate 14 need to be coordinated so that pins 60 will engage holes 62.

While it would be possible to fabricate the first plate as a conventional casting or with a conventional injection type process, such processes may be less desirable in some circumstances than the one described hereinafter because of their relatively high cost and the difficulty in obtaining a smooth finish to prevent snagging the hair.

Figure 9:
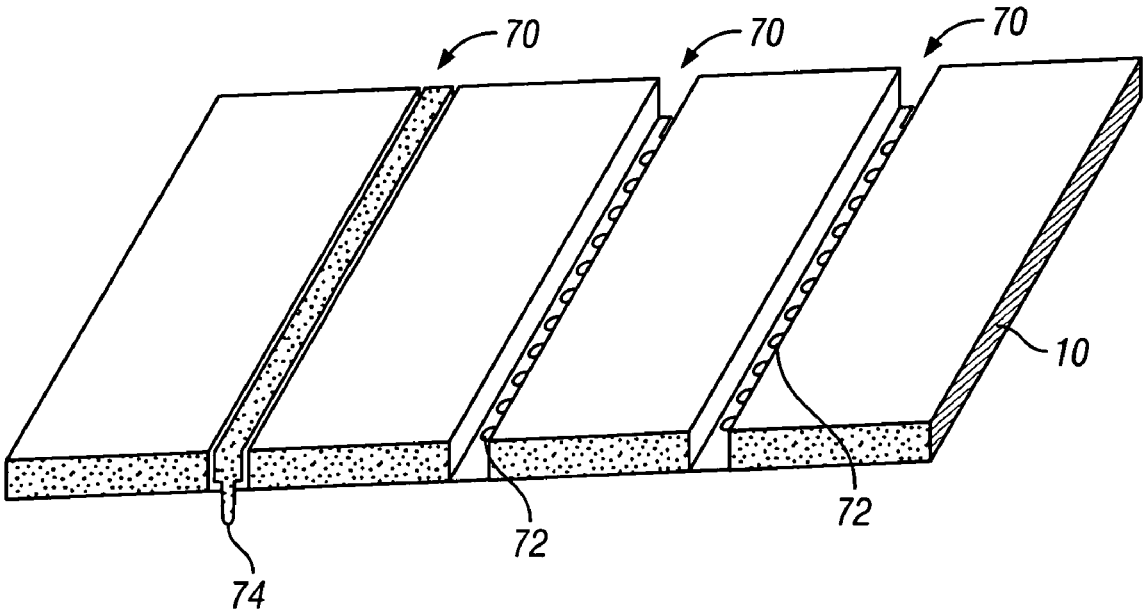
FIGS. 9-18 are drawings illustrating the manufacture of a hair styling apparatus in accordance with various embodiments of the present invention.

FIG. 9 illustrates how the first plate 10 is fabricated in accordance with one embodiment of the invention. Plate 10 includes a number of slots 70 which include holes 72. A brush-like structure 74 includes a number of pins 60 disposed along its structure. The location of the pins on the comb-like structure 74 mates with holes 72 in a corresponding slot 70 of plate 10. By having the shape of the pins slightly larger in at least one direction than the holes into which the pins are fit, the comb-like structure 74 can be permanently press fit into corresponding slot 70.

If desired, additional alternative or supplemental attachment mechanisms may be used, such as spot welding where the components are metal, adhesives and/or melting where plastics are used. The advantage of this approach is that a smooth finish may be provided to the plate 10 using conventional techniques for preparing a flat surface with a smooth finish. The pins (which may be cast, molded, injected, machined, or otherwise prepared) are then simply inserted through the holes 72 and held in place as discussed above. The fabrication of smooth pins is a conventionally available technology, and thus, the fabrication of the plate 10 in this way yields a snag-free surface with relatively little effort and at relatively low cost.

Figure 10:
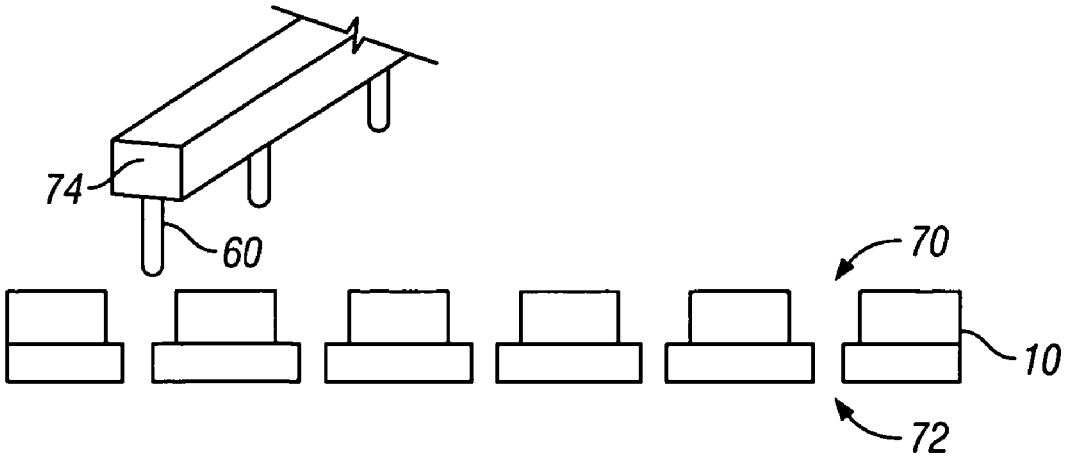
Figure 11:
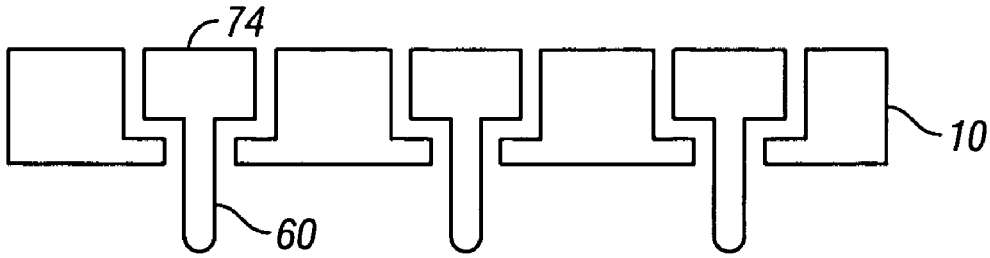
Figure 12:
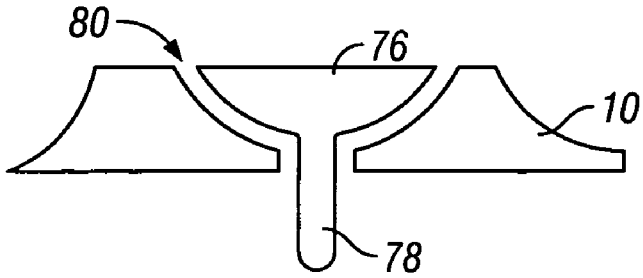
Figure 13:
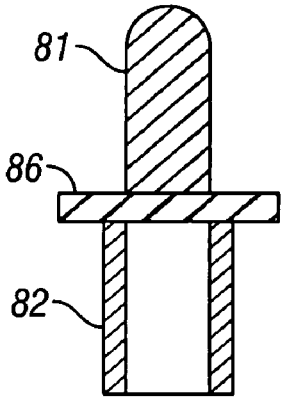
Figure 14:
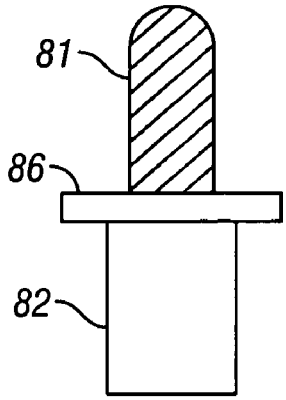
Figure 15:
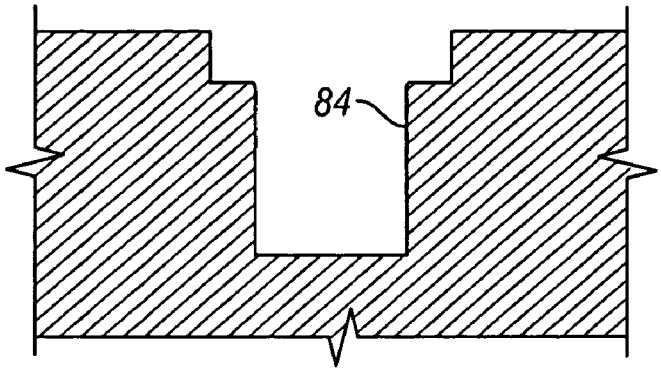
Figure 16:
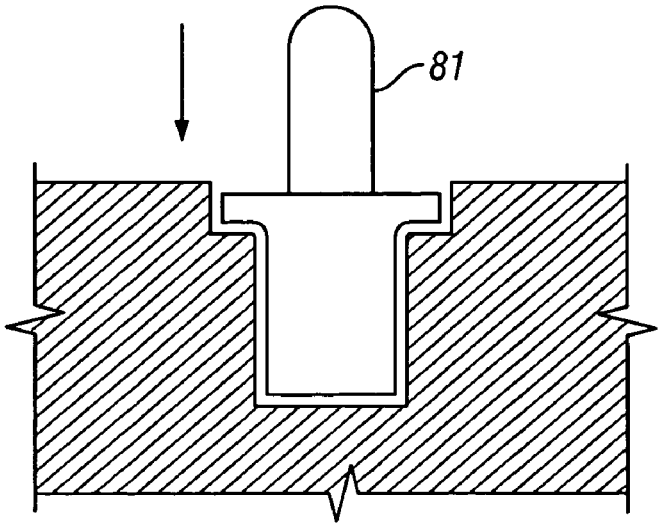

FIG. 10 illustrates a side elevation of plate 10 showing how comb-like structures 74 are inserted therethrough. FIG. 11 illustrates the assembled plate 10. FIG. 12 illustrates an alternative embodiment wherein individual pin carriers 76 (each carrying one pin 78) are inserted into a plurality of receptacles 80 on the back of the plate 10 and may be held in place by an interference fit and/or adhesive or welding techniques.

Another method of fabricating the plate and pin structure is illustrated in FIGS. 13-16. In this embodiment the pins 81 have bases 82 which are substantially hollow cylinders. The plate 10 includes holes 84 which are cylindrical and have diameters slightly less than the outside diameter of the base 82 so that the base can be press-fitted into the holes 84. A flange 86 is affixed to the pin and base to cooperate with a corresponding hole 84 in the plate.

Figure 17:
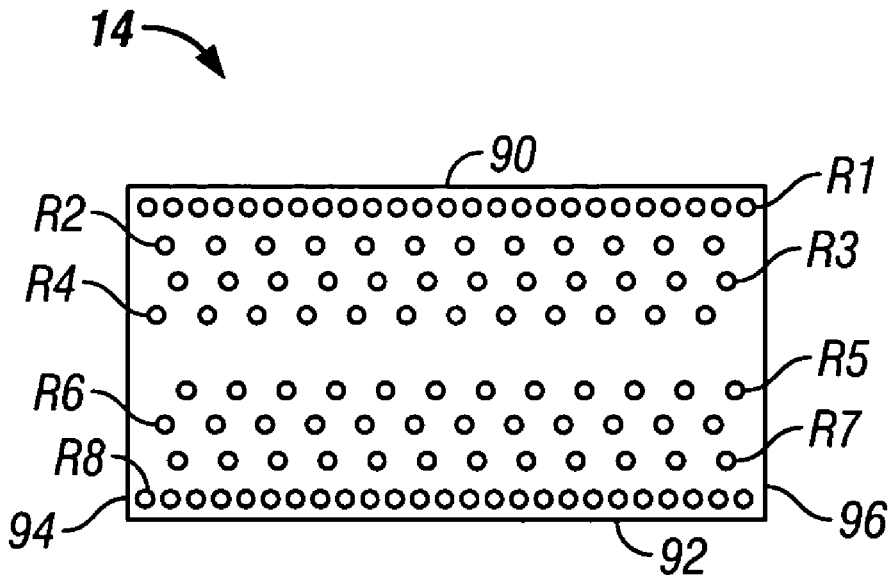
Figure 18:
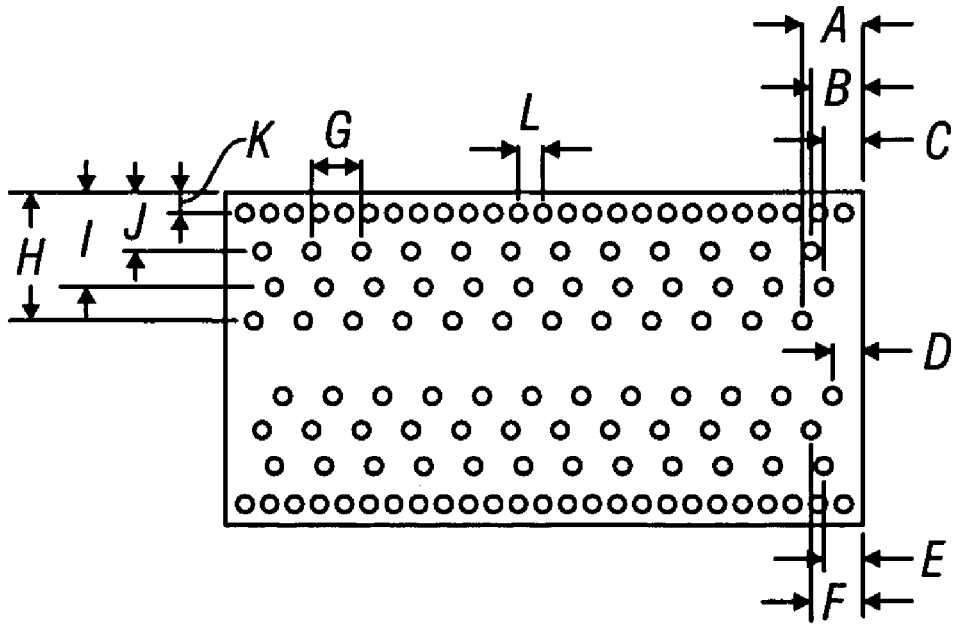

I have found that the location of the pins 60 relative to one another and similarly the relationship of the holes 62 relative to one another is an important factor in the best operation of the device. FIGS. 17 and 18 illustrate the preferred location of the holes 62, and it should be understood that the location of the pins is identical to the location of the holes, so the preferred location of the pins will not be shown in another figure. As shown in FIG. 17 the holes are located in 8 rows, labeled R1 through R8, which are parallel to first edge 90 and second edge 92 of the plate 14. Also, the rows R1 through R8 extend between the distal end of the plate 14, which is labeled 94, and the proximal end, which is labeled 96.

In FIG. 18 the location of the holes are shown. The following dimensions are in millimeters and are to the centers of the holes. A=10.10, B=8.80, C=6.10, D=4.80, E=6.40, F=8.80, G=7.90, H=21.20, I=15.40, J=9.60, K=3.20, and L=3.95. Two of these dimensions should be emphasized. Distance L is the distance between the centers of each of the holes in rows R1 and R8, namely 3.95 mm, and distance G is the distance between the centers of each of the holes in all other rows, i.e. rows R2 through R7, namely 7.90 mm. An important point to note is that the distances between the holes in rows R1 and R8 are significantly less than the distances between the holes in the other rows. I have found that this spacing is important to detangling curly or wavy hair and that drawing curly or wavy hair through the device is facilitated by such spacing.

It should be understood that the holes are spaced as follows:

The first row of holes R1 is spaced apart from the nearest edge of the second plate 14 by a first distance. The second row of holes R2 is spaced apart from the first row R1 by a second distance. The third row of holes R3 is spaced apart from the second row R2 by a third distance, and the fourth row of holes R4 is spaced apart from the third row R3 by a fourth distance. The second distance is greater than the first distance and the third distance is substantially equal to the fourth distance.

The eighth row of holes R8 is spaced apart from the nearest edge of the second plate 14 by an ninth distance. The seventh row of holes R7 is spaced apart from the eighth row R8 by an eighth distance. The sixth row of holes R6 is spaced apart from the seventh row by a seventh distance, and the fifth row of holes R5 is spaced apart from the sixth row R6 by a sixth distance. The eighth distance is greater than the ninth distance and the seventh distance is substantially equal to the sixth distance.

The fifth row of holes R5 is spaced apart from the fourth row R4 by a fifth distance, and the fifth distance is greater than the fourth distance.

Each hole in the first row R1 is spaced apart from the adjacent hole or holes in the first row R1 by a first distance in the direction perpendicular to the direction of the row R1, i.e. a first Y distance. Each hole in the second row of holes R2 is spaced apart from the adjacent hole or holes in the second row of holes R2 by a second Y distance, and the first Y distance is less than the second Y distance.

Like the holes, the pins are spaced as follows:

The first row of pins R1 is spaced apart from the nearest edge of the second plate 14 by a first distance. The second row of pins R2 is spaced apart from the first row R1 by a second distance. The third row of pins R3 is spaced apart from the second row R2 by a third distance, and the fourth row of pins R4 is spaced apart from the third row R3 by a fourth distance. The second distance is greater than the first distance and the third distance is substantially equal to the fourth distance.

The eighth row of pins R8 is spaced apart from the nearest edge of the second plate 14 by an ninth distance. The seventh row of pins R7 is spaced apart from the eighth row R8 by an eighth distance. The sixth row of pins R6 is spaced apart from the seventh row by a seventh distance, and the fifth row of pins R5 is spaced apart from the sixth row R6 by a sixth distance. The eighth distance is greater than the ninth distance and the seventh distance is substantially equal to the sixth distance.

The fifth row of pins R5 is spaced apart from the fourth row R4 by a fifth distance, and the fifth distance is greater than the fourth distance.

Each pin in the first row R1 is spaced apart from the adjacent pin or pins in the first row R1 by a first distance in the direction perpendicular to the direction of the row R1, i.e. the first Y distance. Each pin in the second row of pins R2 is spaced apart from the adjacent pin or pins in the second row of pins R2 by a second Y distance, and the first Y distance is less than the second Y distance.

Although a specific layout of pins and holes has been described and illustrated, it should be understood that this layout is only one embodiment, and the present invention is not limited to this specific layout.

It should be understood that when a user closes the handles 20 and 22 to bring the plates 10 and 14 to bear on hair, it is critical that the pins line up with corresponding holes. Due to flex in the hinge 24 it is important to provide alignment of the pins and holes to insure correct alignment. Alignment of the pins and holes is accomplished by means of two guide members 42 and 46.

Figure 19:
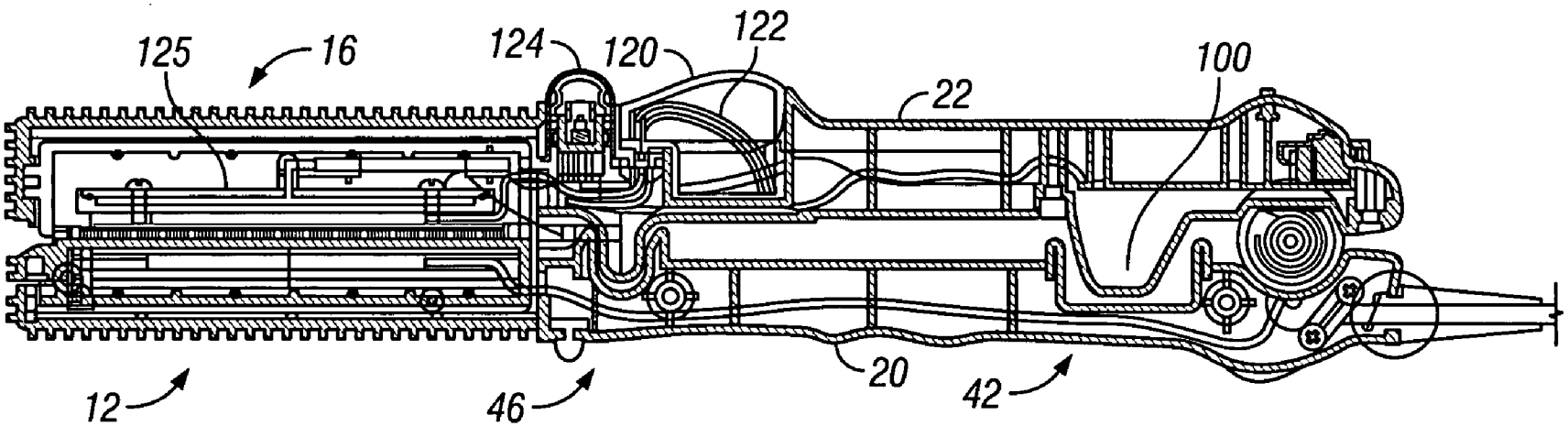
FIG. 19 is a cross sectional view of the device shown in FIG. 2, taken along line 19-19 of FIG. 2.

Turning now to FIGS. 19-21, the proximal guide member 42 includes a proximal male alignment part 48 coupled to the second handle member 22 and a proximal female alignment part 50 coupled to the first handle member 20. The proximal male alignment part 48 has two faces 100 and 102 which are shaped substantially as truncated triangles when viewed in FIG. 19. The two faces 100 and 102 are spaced apart from one another where they are fixed to the handle 22, and the faces are connected to one another at their ends which are spaced apart from the handle 22. Accordingly, when viewed in FIG. 20 it can be seen that the faces 100 and 102 are nearer to one another in the horizontal direction when they are farther from the handle 22 in the vertical direction. The proximal female alignment part 50 has two faces 104 and 106. The two faces 104 and 106 are spaced apart from one another where they are fixed to the handle 20, and the faces are a greater distance from one another at their ends which are spaced apart from the handle 20.

The proximal male alignment part 48 and the proximal female alignment part 50 are constructed and arranged so that when the handle is in the open position the alignment parts are not engaged with one another. As the user moves the handles toward the closed position the proximal male alignment part 48 and the proximal female alignment part 50 engage one another and tend to force the handles into alignment to the extent that they are out of alignment. In other words, when a user moves the handle from a first partially closed position to second partially closed position and from the second partially closed position to the closed position the proximal alignment parts engage one another to cause initial alignment of the first plate and the second plate.

The distal guide member 46 comprises a distal male alignment part 52 coupled to the second handle member 22 and a distal female alignment part 54 coupled to the first handle member 20. The distal male alignment part 52 includes a substantially cone shaped structure 108 connected to the handle 22 and a substantially cylindrical part 110 connected to the lower end of the cone shaped structure 108. The distal female alignment part 54 includes a conical shaped opening 112 which is sized to fit snugly around the cone shaped structure 108.

The distal male alignment part 52 and the distal female alignment part 54 are constructed and arranged so that when the handle is in the open position the alignment parts do not engage one another. As a user moves the handles toward the closed position the handles reach a first partially closed position and the proximal alignment members 48 and 50 initially contact one another to bring about partial alignment. At this time the distal alignment members 52 and 54 do not engage one another. Thereafter, as the user continues to close the handles, and when the handles reach a second partially closed position, the distal alignment parts engage one another to cause final alignment of the first plate and the second plate as the user closes the device.

In accordance with one embodiment of the present invention, dry heat may be provided to one or both of plates 10 and 14 by incorporating a conventional electrical heating coil 114 behind each respective plate. In this case it would be desirable to form the respective heated (and non-heated) surface of the temperature resistant materials, such as aluminum and high temperature plastics such as Teflon. An electrical switch 116 is located in the handle to control one or both electrical heating coils. Conventional AC power is provided by wires 118 to power the circuit, which is not shown.

With reference to FIGS. 19 and 22-25, in accordance with a preferred embodiment of the present invention, steam is provided through holes in the second plate 14.

The second handle member 22 includes a water reservoir 120, and a metered amount of water can be drawn from the reservoir 120 through tube 122 by activation of a pumping mechanism by trigger 124. The water then flows to steam generator 125 which is heated by a heating element 126. This heated water therein forms steam, which then exits the steam emitting holes 128 disposed along the lower surface of steam generator 125. Heating element 126 is supplied electrical current via wires 118. From the steam emitting holes 128 the steam travels through holes 131 in the plate 14.

Figure 22:
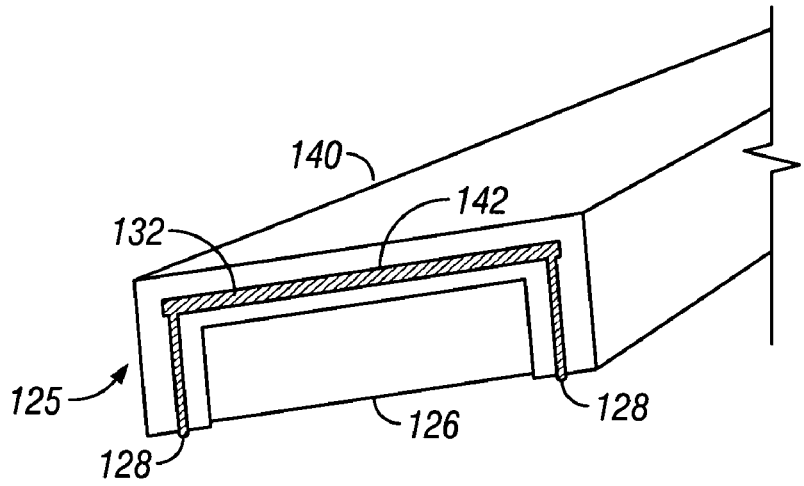
FIG. 22 is a detailed perspective view of a heater and steam generator of a hair styling apparatus in accordance with one embodiment of the present invention.

As shown in FIG. 22 the steam generator 125 comprises a body 140 which is substantially C-shaped in cross section and extends substantially the length of second housing 16. Within the body 140 there is a steam chamber 142 wherein the water is vaporized and which is substantially C-shaped in cross section and is in communication with the steam emitting holes 128. The steam chamber 142 contains felt 132. The purpose of the felt 132 is to reduce or eliminate the possibility of any condensation which forms in the steam chamber 142 from leaving the steam generator as water droplets.

Figure 23:
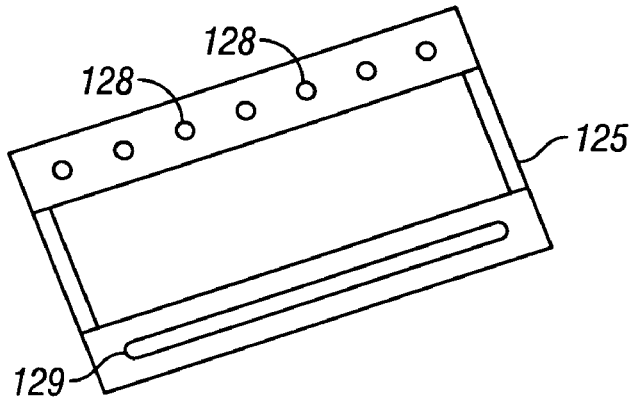
FIG. 23 is another view of the heater shown in FIG. 22.

As can be seen in FIG. 23, as an alternative to a plurality of steam emitting holes 128 disposed along the bottom faces of steam generator 125, slots 129 can be formed along the bottom of the steam generator 125. As can be seen from FIG. 25 the water reservoir 120 is removable from the handle 22, and the handle includes a compartment 130 to accommodate the water reservoir. The reservoir 120 can be removed to facilitate filling it with water.

Figure 26:
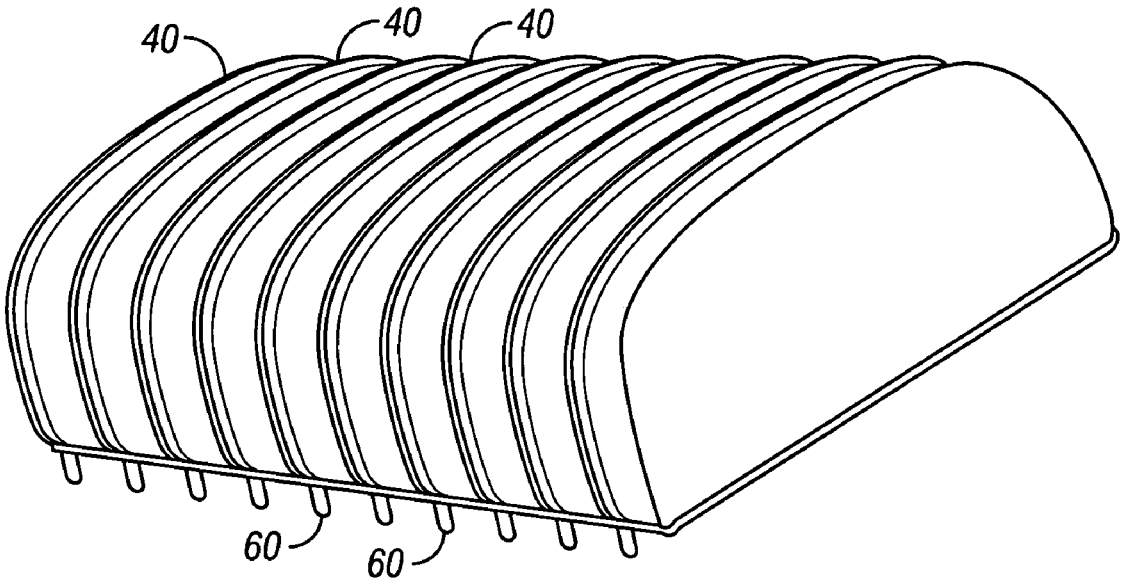
FIGS. 26-28 are detailed illustrations showing a device in accordance with an embodiment of the present invention as it can be used with hair.
Figure 27:
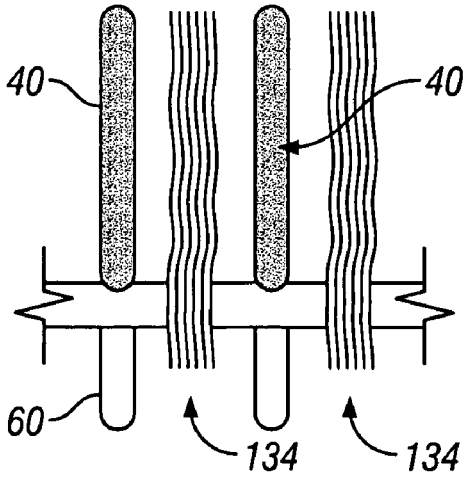
Figure 28:
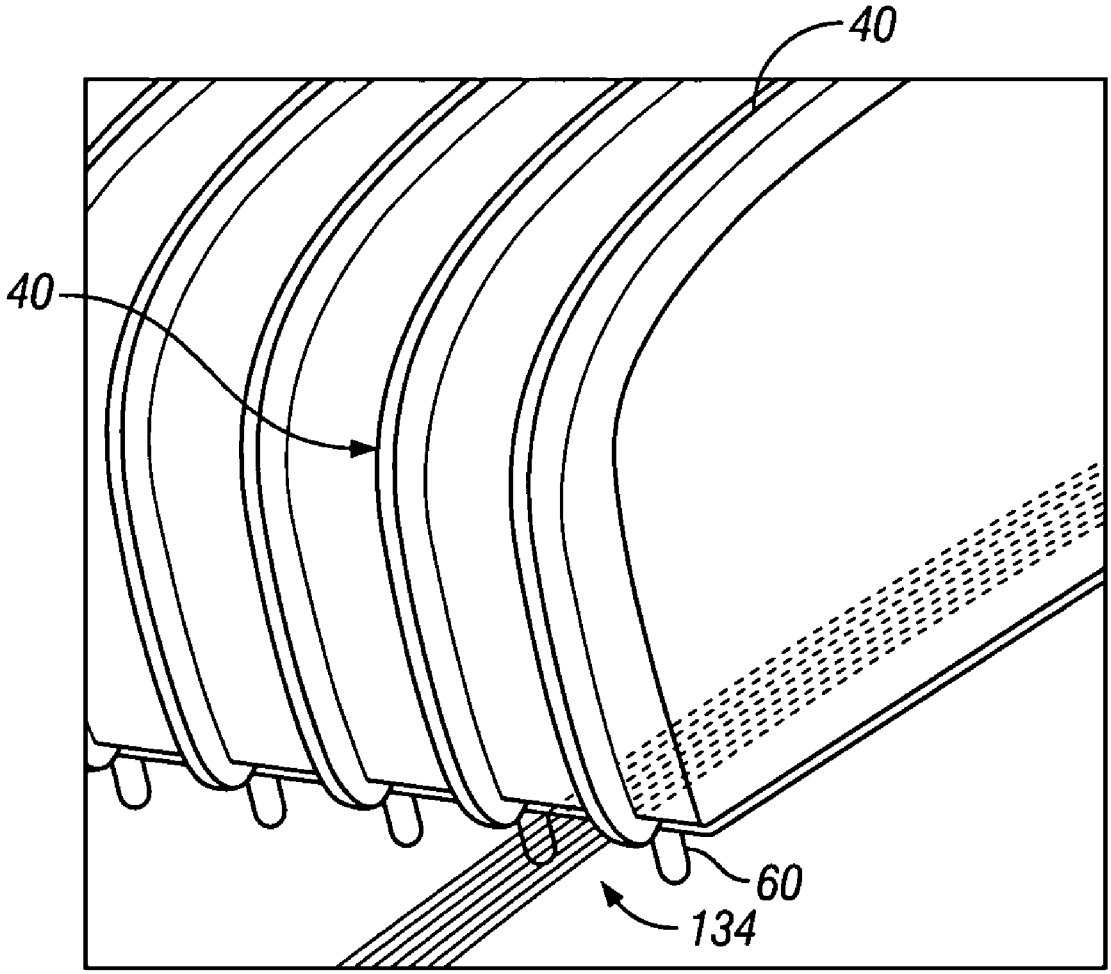
Figure 29:
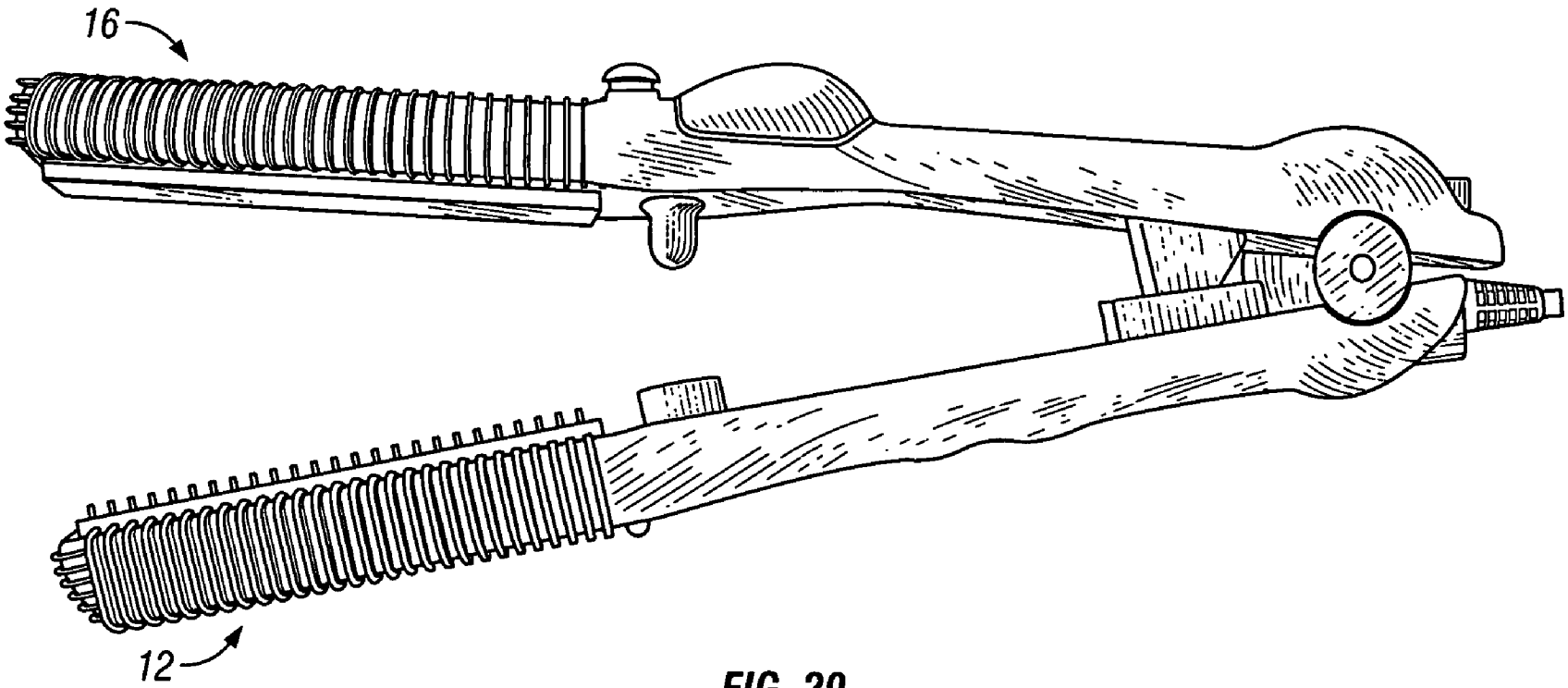
FIG. 29 is a side view of an apparatus for hair styling in accordance with one embodiment of the present invention in the open position.
Figure 30:
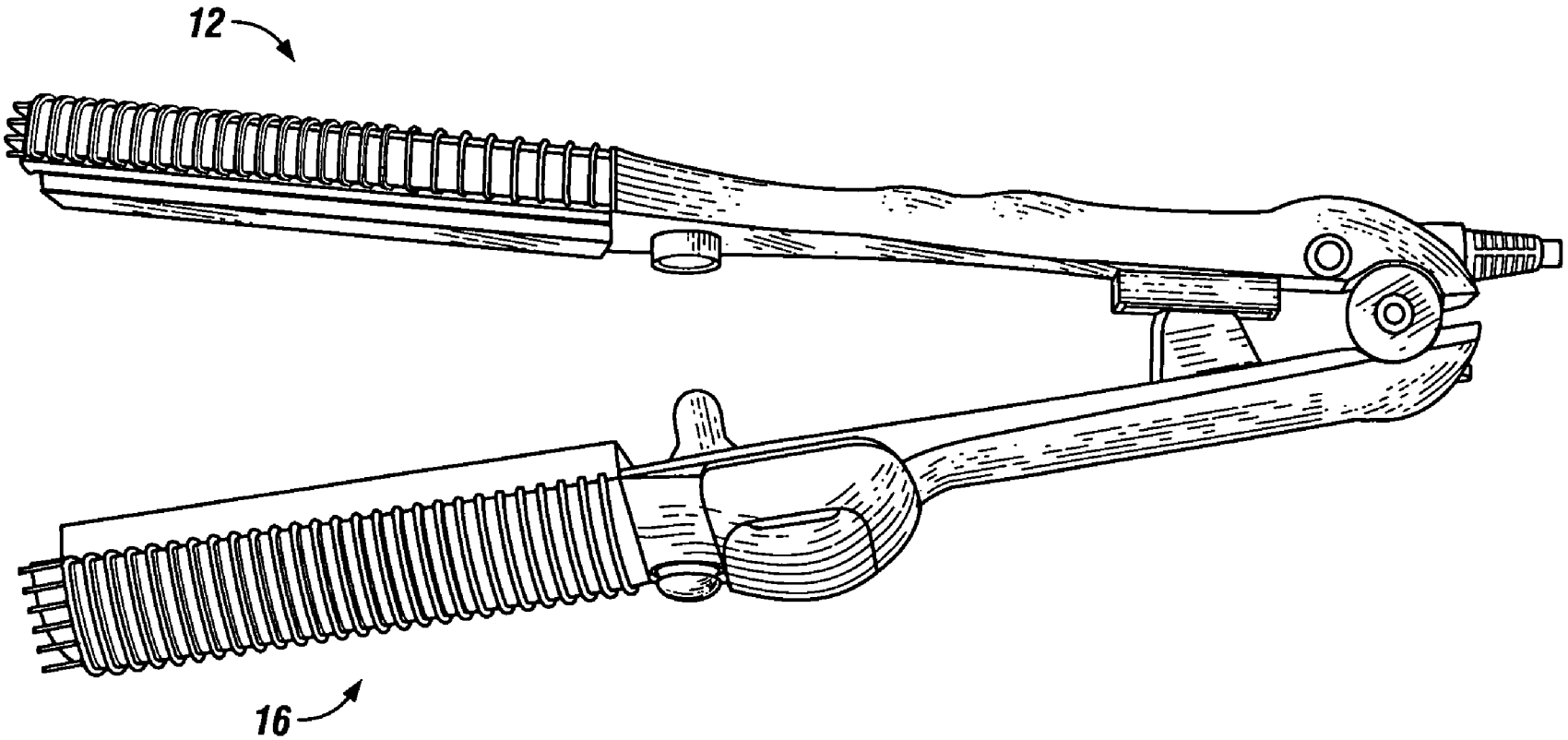
FIG. 30 is a side view of an apparatus for hair styling in accordance with one embodiment of the present invention in the open position.
Figure 31:
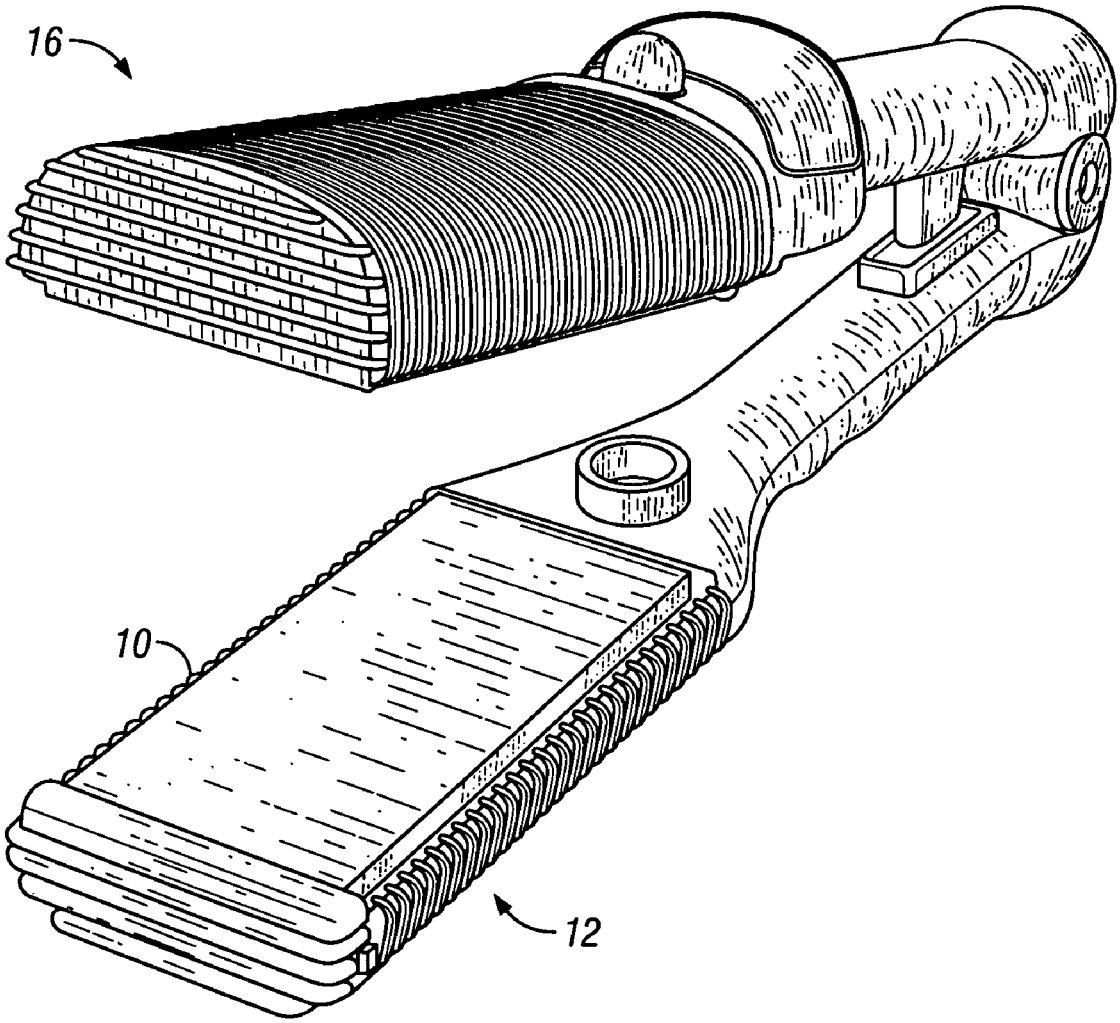
FIG. 31 is an end view of an apparatus for hair styling in accordance with one embodiment of the present invention in the open position.

With reference to FIGS. 26-28 it can be seen that the fins 40 are aligned with certain of the pins 60. More specifically, when the present device is used to straighten hair 134 it is important that the hair be maintained substantially straight throughout the process. Accordingly, in the preferred embodiment of the present device one fin 40 is aligned with each pin 60 in the first row of pins R1. The fins are linear and extend around the housing 12, and on the opposite side of the plate 10 are aligned with a corresponding pin 60 in the eighth row of pins R8, not shown. Since the pins in both rows R1 and R8 are aligned with a fin 40 the user can conveniently use the device effectively with either hand and on either side the head.

It should be noted that while the specific layout of pins and corresponding aperture is viewed as an aspect of the present invention, it is not critical to the entire invention and other aspects of the invention may be used with or without this particular aspect of the invention.

It should also be noted that fins 40 may extend beyond the plane of the upper surface of the corresponding heated plates 10, 14 to provide additional protection to prevent having a finger or other part of the body come in contact with the heated plates 10, 14. Similarly, while round pins and apertures are shown and described herein, other shapes could also be employed and will now be apparent to those of ordinary skill in the art.

While embodiments and applications of this invention have been shown and described, it would be apparent to those skilled in the art having the benefit of this disclosure that many more modifications than mentioned above are possible without departing from the inventive concepts herein. The invention, therefore, is not to be restricted except in the spirit of the appended claims.

What is claimed is:

1. A device for styling hair comprising:

a first plate including a plurality of pins;

a second plate including a plurality of holes configured to receive respective pins from the first plate; and a hinged frame configured to hold the first plate and the second plate and hinged to permit a user to bring the first plate and the second plate into contact with one another, wherein the first plate includes a plurality of slots, each of the slots includes a plurality of holes, and each slot has a structure having a portion of the plurality of pins inserted so that the pins pass through the holes of the respective slot.

2. The apparatus of claim 1, wherein the holes and the pins are arranged in a one to one configuration.

3. The apparatus of claim 1, wherein:

the holes and the pins are configured so that more than one pin is arranged to enter one hole when the apparatus is used.

4. The apparatus of claim 1, wherein:

the holes are configured as slots.

5. An apparatus for styling hair, comprising:

a first plate that is substantially rectangular and has at least a first edge and a second edge;

a plurality of pins configured to extend a given length from the first plate, the pins disposed in at least two rows, each row substantially parallel to an edge of the first plate, the first row of the pins spaced apart from the first edge of the first plate by a first distance, the second row of the pins spaced apart from the first row by a second distance, wherein each pin in the first row of pins is spaced apart from adjacent pins in the first row of pins by a first Y distance, each pin in the second row of pins is spaced apart from adjacent pins in the second row of pins by a second Y distance, and the first Y distance is less than the second Y distance;

at least a third row and a fourth row of pins, the third row of the pins spaced apart from the second row by a third distance, and the fourth row of the pins spaced apart from the third row by a fourth distance, wherein the second distance is greater than the first distance and the third and fourth distances are each substantially equal to each other;

a second plate which is substantially rectangular and which includes a plurality of holes therein to correspond with the pins extending from the first plate;

handle means coupled to the plates to permit a user to bring the plates into engagement with one another; and a heater coupled to at least one of the first and second plates to heat at least one of the plates.

6. An apparatus for styling hair, comprising:

a first plate which is substantially rectangular and has two long edges and two short edges;

a plurality of pins configured to extend from the first plate, the pins disposed in eight rows, each row substantially parallel to a first long edge of the first plate, the first row of the pins spaced apart from the first long edge of the first plate by a first distance, the second row spaced apart from the first row by a second distance, the third row spaced apart from the second row by a third distance, and the fourth row spaced apart from the third row by a fourth distance, wherein the second distance is greater than the first distance and the third and fourth distances are each substantially equal to each other, the eighth row of the pins spaced apart from the second long edge of the first plate by a ninth distance, the seventh row spaced apart from the eighth row by an eighth distance, the sixth row spaced apart from the seventh row by a seventh distance, and the fifth row spaced apart from the sixth row by a sixth distance, wherein the eighth distance is greater than the ninth distance and the seventh and sixth distances are each substantially equal to each other, the fifth row of the pins spaced apart from the fourth row of the pins by a fifth distance, wherein the fifth distance is greater than the fourth distance, wherein each pin in the first row of pins is spaced apart from adjacent pins in the first row of pins by a first Y distance, each pin in the second row of pins is spaced apart from adjacent pins in the second row of pins by a second Y distance, and the first Y distance is less than the second Y distance;

a second plate which is substantially rectangular and which includes a plurality of holes therein, the holes disposed in eight rows, each row substantially parallel to a first long edge of the second plate, the first row of the holes spaced apart from the first long edge of the second plate by a first distance, the second row spaced apart from the first row by a second distance, the third row spaced apart from the second row by a third distance, and the fourth row spaced apart from the third row by a fourth distance, wherein the second distance is greater than the first distance and the third and fourth distances are each substantially equal to each other, the eighth row of the holes spaced apart from the second long edge of the second plate by an ninth distance, the seventh row spaced apart from the eighth row by an eighth distance, the sixth row spaced apart from the seventh row by a seventh distance, and the fifth row spaced apart from the sixth row by a sixth distance, wherein the eighth distance is greater than the ninth distance and the seventh and sixth distances are each substantially equal to each other, the fifth row of the holes spaced apart from the fourth row of the holes by a fifth distance, wherein the fifth distance is greater than the fourth distance, wherein each hole in the first row of holes is spaced apart from adjacent holes in the first row of holes by a first Y distance, each hole in the second row of holes is spaced apart from adjacent holes in the second row of holes by a second Y distance, and the first Y distance is less than the second Y distance;

a first housing coupled to the first plate;

a second housing coupled to the second plate;

a handle coupled to the first and second housings, the handle operable between an open position and a closed position, the pins of the first plate and the holes of the second plate configured to engage with one another when the handle is in the closed position;

a vapor generator disposed within the second housing, the vapor generator configured to heat aqueous fluid to vaporization;

a refillable reservoir for containing fluid coupled in fluid flow communication with the vapor generator;

a pump coupled in fluid flow communication with the refillable reservoir and the vapor generator, the pump configured to withdraw a metered volume of fluid from the reservoir and place the metered volume of fluid in contact with the vapor generator; and a passage connecting the vapor generator and a plurality of holes which extend through the second plate, the passage configured so that vaporized fluid can pass from the holes.

7. The apparatus of claim 6, further comprising a trigger configured to actuate the pump.

8. The apparatus of claim 6, wherein the refillable reservoir is configured to be detachable from the vapor generator.

9. An apparatus for styling hair, comprising:

a first plate having a plurality of pins extending therefrom;

a second plate having a plurality of holes therein;

a first housing coupled to the first plate;

a second housing coupled to the second plate;

a handle including a first handle member wherein a distal end of the first handle member is coupled to the first housing, the handle further including a second handle member wherein a distal end of the second handle member is coupled to the second housing, a proximal end of the first handle member coupled to a proximal end of the second handle member by a hinge, the handle configured to be operable between an open position and a closed position, the handle including a proximal guide member and a distal guide member affixed to the first handle member and the second handle member, the proximal guide member including a proximal male alignment part coupled to the first handle member and a proximal female alignment part coupled to the second handle member, the proximal male alignment part and the proximal female alignment part configured so that when the handle is in the open position the alignment parts are not engaged with one another, and when a user moves the handle from a first partially closed position to second partially closed position and from the second partially closed position to the closed position the proximal alignment parts engage one another to cause initial alignment of the first plate and the second plate, the distal guide member including a distal male alignment part coupled to the first handle member and a distal female alignment part coupled to the second handle member, the distal male alignment part and the distal female alignment part configured so that when the handle is in the open position and when the handle is between the first partially closed position and the second partially closed position, the distal alignment parts are not engaged with one another, and when a user moves the handle from the second partially closed position to the closed position the distal alignment parts engage one another to cause final alignment of the first plate and the second plate, the pins of the first plate and the holes of the second plate configured to engage with one another when the handle is in the closed position;

a vapor generator disposed within the second housing, the vapor generator configured to heat aqueous fluid to vaporization;

a refillable reservoir configured to contain fluid coupled in fluid flow communication with the vapor generator;

a pump coupled in fluid flow communication with the refillable reservoir and the vapor generator, the pump configured to withdraw a metered volume of fluid from the reservoir and place the metered volume of fluid in contact with the vapor generator; and a passage coupling the vapor generator and a plurality of holes which extend through the second plate, the passage configured so that vaporized fluid can pass from the holes.

10. The apparatus of claim 9, further comprising a trigger configured to actuate the pump.

11. The apparatus of claim 9, wherein the refillable reservoir is configured to be detachable from the vapor generator.

12. The apparatus of claim 9, wherein the holes and the pins are arranged in a one to one configuration.

13. The apparatus of claim 9, wherein:

the holes and the pins are configured so that more than one pin is arranged to enter one hole when the apparatus is used.

14. The apparatus of claim 13, wherein:

the holes are configured as slots.

15. An apparatus for styling hair, comprising:

a first plate that is substantially rectangular and has at least a first edge and a second edge;

a plurality of pins configured to extend a given length from the first plate, the pins disposed in at least two rows, each row substantially parallel to an edge of the first plate, the first row of the pins spaced apart from the first edge of the first plate by a first distance, the second row of the pins spaced apart from the first row by a second distance, wherein each pin in the first row of pins is spaced apart from adjacent pins in the first row of pins by a first Y distance, each pin in the second row of pins is spaced apart from adjacent pins in the second row of pins by a second Y distance, and the first Y distance is less than the second Y distance;

a second plate which is substantially rectangular and which includes a plurality of holes therein to correspond with the pins extending from the first plate, the holes and the pins configured so that more than one pin is arranged to enter one hole when the apparatus is used;

handle means coupled to the plates to permit a user to bring the plates into engagement with one another; and a heater coupled to at least one of the first and second plates to heat at least one of the plates.

16. The apparatus of claim 15, wherein:

the holes are configured as slots.

* * * * *